US009737464B2

(12) United States Patent
Hausman

(10) Patent No.: US 9,737,464 B2
(45) **Date of Patent: *Aug. 22, 2017**

(54) BABY BOTTLE HOLDING DEVICES, SYSTEMS AND METHODS

(71) Applicant: Harley Hausman, Earp, CA (US)

(72) Inventor: Harley Hausman, Earp, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/184,093

(22) Filed: Jun. 16, 2016

(65) Prior Publication Data

US 2017/0065490 A1 Mar. 9, 2017

Related U.S. Application Data

(63) Continuation of application No. 14/678,391, filed on Apr. 3, 2015, now Pat. No. 9,370,468, which is a continuation of application No. 14/465,093, filed on Aug. 21, 2014, now Pat. No. 8,998,029.

(51) Int. Cl.
*A61J 9/06* (2006.01)
*A61J 11/00* (2006.01)

(52) U.S. Cl.
CPC ..... *A61J 9/0669* (2015.05); *A61J 9/0623* (2015.05); *A61J 11/00* (2013.01)

(58) Field of Classification Search
CPC A61J 9/0669; A61J 9/0623; A61J 9/06; A61J 11/00
USPC ..... 220/737, 738, 739, 903, 23.91; 215/396, 215/395
See application file for complete search history.

(56) References Cited

U.S. PATENT DOCUMENTS

| | | | |
|---|---|---|---|
| 3,058,708 | A | 10/1962 | Murray et al. |
| 3,073,493 | A | 1/1963 | Pfaffenberger |
| 3,773,287 | A | 11/1973 | Hechinger |
| 4,014,505 | A | 3/1977 | Dowd |
| 4,497,417 | A | 2/1985 | Tabet |
| 4,723,801 | A | 2/1988 | Musumeci et al. |
| 4,941,579 | A | 7/1990 | Lee |
| 4,943,017 | A | 7/1990 | Ennis |

(Continued)

OTHER PUBLICATIONS

International Search Report and Written Opinion received in co-pending International Patent Application No. PCT/US2015/045954, mailed Dec. 14, 2015 in 13 pages.

(Continued)

*Primary Examiner* — King M Chu
(74) *Attorney, Agent, or Firm* — Knobbe Martens Olson & Bear, LLP

(57) ABSTRACT

A support system for a baby bottle has a support body having a generally cylindrical portion. A channel is defined within the support body. A slot is defined between slot edges of the support body extending between a first end portion and a second end portion. First and second handle portions are coupled to the support body. The first and second handle portions are coupled to the support body at an angle less than about 120 degrees apart from each other about a surface of the support body. The support body is sized and configured to support a baby bottle positioned within the channel defined within the support body. In some embodiments, the first and second handle portions have handle grip portions that are coupled to the support body at an angle between about 5 degrees and about 30 degrees relative to a surface of the support body.

25 Claims, 8 Drawing Sheets

(56) References Cited

U.S. PATENT DOCUMENTS

| | | | | | |
|---|---|---|---|---|---|
| 5,060,816 | A | | 10/1991 | Robbins, III | |
| 5,174,965 | A | * | 12/1992 | Jones | B01L 3/508 215/396 |
| 5,573,141 | A | * | 11/1996 | Chen | A47G 19/2288 220/592.17 |
| 5,655,805 | A | * | 8/1997 | Shaddy | A47J 45/077 220/738 |
| 5,765,715 | A | | 6/1998 | Hughes | |
| 5,772,069 | A | | 6/1998 | Price | |
| 5,800,319 | A | * | 9/1998 | Choate | A63B 69/34 482/83 |
| 5,816,631 | A | | 10/1998 | Kochan | |
| 6,037,872 | A | | 3/2000 | Dunnum | |
| 6,315,153 | B1 | | 11/2001 | Oxborn | |
| 7,954,773 | B2 | | 6/2011 | Carnevali | |
| 8,123,069 | B1 | | 2/2012 | Mumaw et al. | |
| 8,152,012 | B1 | | 4/2012 | Berglund | |
| 8,998,029 | B1 | | 4/2015 | Hausman | |
| 9,370,468 | B2 | | 6/2016 | Hausman | |

OTHER PUBLICATIONS

International Preliminary Report on Patentability received in co-pending International Application No. PCT/US2015/045954, issued Feb. 21, 2017 in 8 pages.

* cited by examiner

BABY BOTTLE HOLDING DEVICES, SYSTEMS AND METHODS

TECHNICAL FIELD

The present application relates to systems, devices, and methods for holding baby bottles. In particular, the present application relates to systems, devices, and methods for facilitating the holding of baby bottles by babies.

DESCRIPTION OF THE RELATED TECHNOLOGY

Baby bottles can be difficult for a baby to hold. Bottles are often too large for a baby's hands to grip. Bottles can also be slippery. Babies can lack sufficient coordination to hold a bottle in an appropriate position while also feeding on the contents of the bottle.

Some bottle systems have a cap with two handles connected to the cap that extend directly opposite each other on opposite sides of the cap, and extend down along the sides of the bottle when the cap is positioned on the bottle. Some bottle systems have a ring that is positioned between a top of the bottle and a cap. The ring includes two handles directly opposite each other on opposite sides of the ring that extend along the sides of the bottle when the ring and cap are positioned on the bottle. These systems can be unsatisfactory for some babies to hold. For example, handles on directly opposite sides of the bottle are spaced apart too wide for some babies to hold. Additionally, handles on directly opposite sides of the bottle may be difficult for the baby to hold at an appropriate orientation to deliver the contents of the bottle to the baby for feeding. Additionally, these systems can be unsatisfactory because the handle components are limited to use with a specific bottle system. Additionally, in some of these systems a ring positioned between the cap and bottle can lead to leakage between the cap and bottle.

There exists a need for systems, devices, and methods for holding baby bottles to facilitate holding by babies, provide for improved delivery of the contents of the bottle to the baby, provide systems that are interchangeable with other bottle systems, and limit leakage.

SUMMARY

The systems, methods and devices described herein have innovative aspects, no single one of which is indispensable or solely responsible for their desirable attributes. Without limiting the scope of the claims, some of the advantageous features will now be summarized.

One aspect of the present disclosure is the realization that traditional baby bottle systems lack handle systems that facilitate holding by babies, provide for improved delivery of the contents of the bottle to the baby, provide systems that are interchangeable with other bottle and cup systems, and limit leakage. Thus, there exists a need for a modular handle system which does not suffer from the deficiencies of conventional handle systems.

One non-limiting embodiment of the present disclosure includes a baby bottle holding system. The system comprises a baby bottle. The system comprises a support body having a generally cylindrical portion. A channel is defined within the support body. A slot is defined between slot edges of the support body extending between a first end portion and a second end portion. First and second handle portions are coupled to the support body. The first and second handle portions are coupled to the support body at an angle less than about 120 degrees apart from each other about a surface of the support body. The support body is sized and configured to support the baby bottle when positioned within the channel defined within the support body. In some embodiments, the first and second handle portions have handle grip portions that are coupled to the support body at an angle between about 5 degrees and about 30 degrees relative to a surface of the support body.

In another embodiment, a support system for a baby bottle comprises a support body having a generally cylindrical portion. A channel is defined within the support body. A slot is defined between slot edges of the support body extending between a first end portion and a second end portion. First and second handle portions are coupled to the support body. The first and second handle portions are coupled to the support body at an angle less than about 120 degrees apart from each other about a surface of the support body. The support body is sized and configured to support a baby bottle positioned within the channel defined within the support body. In some embodiments, the first and second handle portions have handle grip portions that are coupled to the support body at an angle between about 5 degrees and about 30 degrees relative to a surface of the support body.

In another embodiment, a support system for a baby bottle comprises a support body having a generally cylindrical portion. The support system comprises a neck portion. A first opening is defined by a first rim of the neck portion at a first end portion. A second opening is defined by a second rim of the support body at a second end portion. A channel is defined within the support body extending between the first opening and the second opening. A slot is defined between slot edges of the support body extending between the first end portion and the second end portion. First and second handle portions are coupled to the support body. The first and second handle portions have handle grip portions and handle attachment portions. The first and second handle portions are coupled to the support body at an angle less than 180 degrees apart from each other about a surface of the support body. The support body is sized and configured to receive, releasably grip, and support a baby bottle positioned within the channel defined within the support body. In some embodiments, the first and second handle portions are coupled to the support body at different angles apart from each other about a surface of the support body. In some embodiments, the first and second handle portions are coupled to the support body at different angles relative to the slot. In some embodiments, the first and second handle portions are coupled to the support body at different angles relative to a surface of the support body. In some embodiments, the first opening generally defines a first opening cross-sectional area, the second opening generally defines a second opening cross-sectional area, and the second opening cross-sectional area is greater than the first opening cross-sectional area.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements.

DETAILED DESCRIPTION

Figure 1:
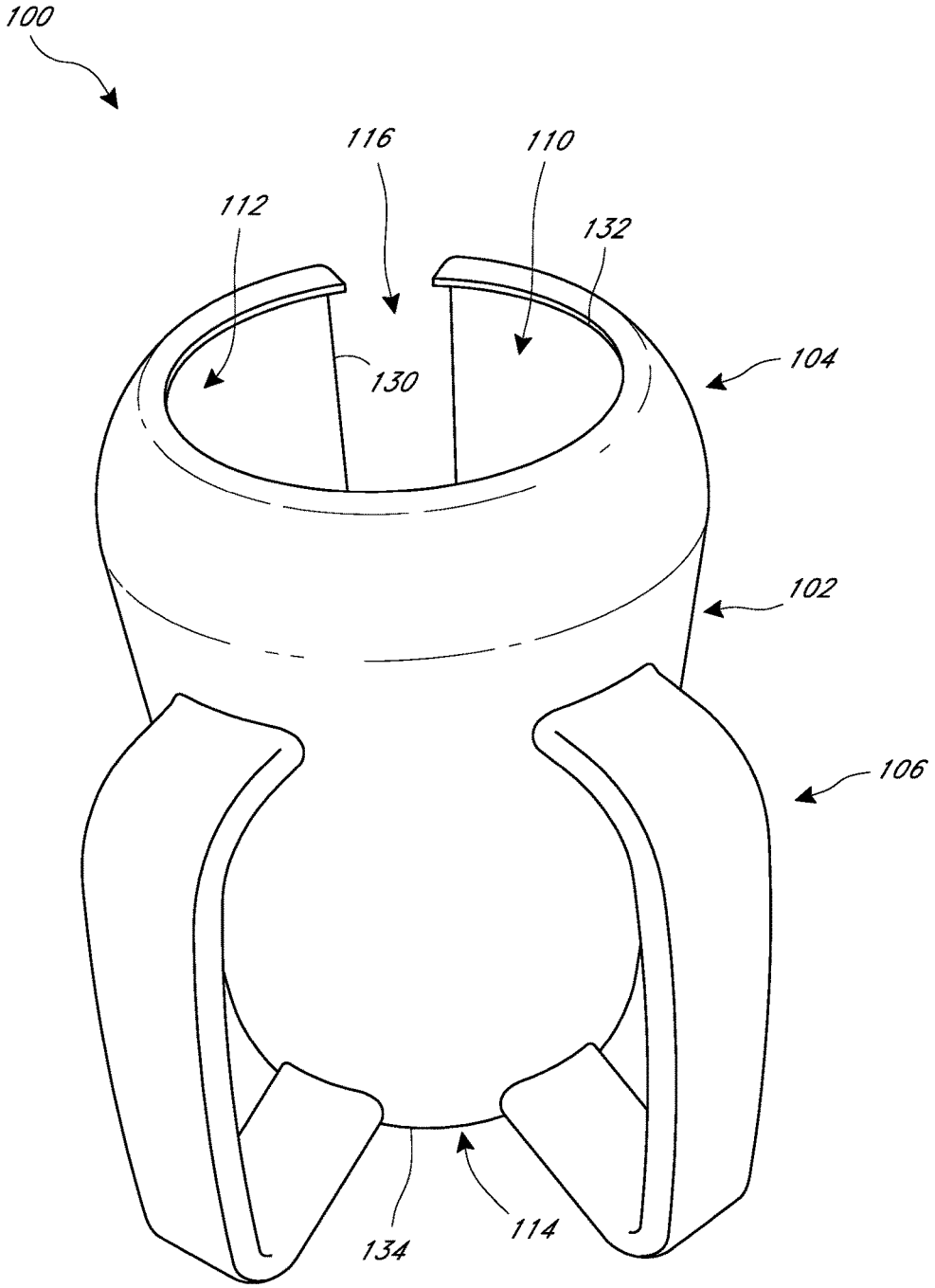
FIG. 1 illustrates a perspective view of one embodiment of a bottle support system.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of the inventive features illustrated herein, and additional applications of the principles of the inventions as illustrated herein, which would occur to one skilled in the relevant art and having possession of this disclosure, are to be considered within the scope of the invention.

Descriptions of unnecessary parts or elements may be omitted for clarity and conciseness, and like reference numerals refer to like elements throughout. In the drawings, the size and thickness of layers and regions may be exaggerated for clarity and convenience.

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description" one will understand how illustrated features serve to explain certain principles of the present disclosure.

Embodiments described herein generally relate to systems, devices, and methods for holding baby bottles. More specifically, some embodiments relate to systems, devices, and methods for facilitating the holding of baby bottles by babies. For example, in some embodiments, a support system for a baby bottle comprises a support body and first and second handle portions coupled to the support body. The support body preferably comprises a channel defined within the support body, and a slot defined in the support body and extending between a first end portion and a second end portion. The first and second handle portions are preferably coupled to the support body at an angle less than about 120 degrees apart from each other about a surface of the support body. The support body is preferably sized and configured to support a baby bottle positioned within the channel defined within the support body. In some embodiments, the first and second handle portions have handle grip portions that are coupled to the support body at an angle between about 5 degrees and about 30 degrees relative to a surface of the support body. Other configurations are also possible, including those described herein.

FIG. 1 illustrates a perspective view of one embodiment of a baby bottle support system 100. In some embodiments, a baby bottle support system 100 can include a support body 102 having a generally cylindrical portion. The support body 102 preferably has an upper curved section forming a neck portion 104. First and second handle portions 106 are coupled to the support body 102.

A channel 110 is defined within the support body 102 extending between a first opening 112 and a second opening 114. The first opening 112 is generally defined by a first rim 132 of the neck portion 104 at a first end portion as shown in the upper portion of FIG. 1. The second opening 114 is generally defined by a second rim 134 of the support body 102 at a second end portion as shown in the lower portion of FIG. 1. A slot 116 is generally defined between slot edges 130 of the support body 102 extending between the first end portion and the second end portion.

Figure 2:
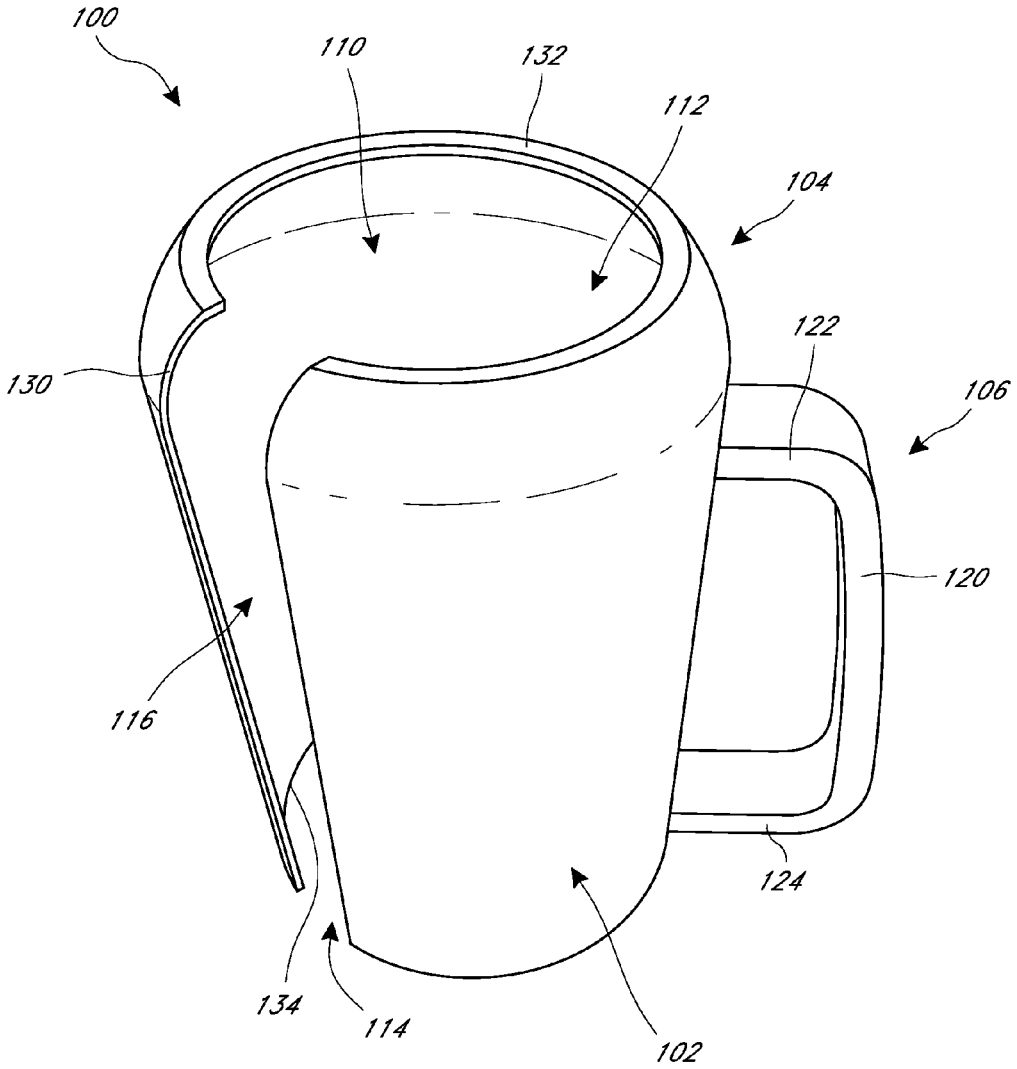
FIG. 2 illustrates a perspective view of the bottle support system of FIG. 1.
Figure 3:
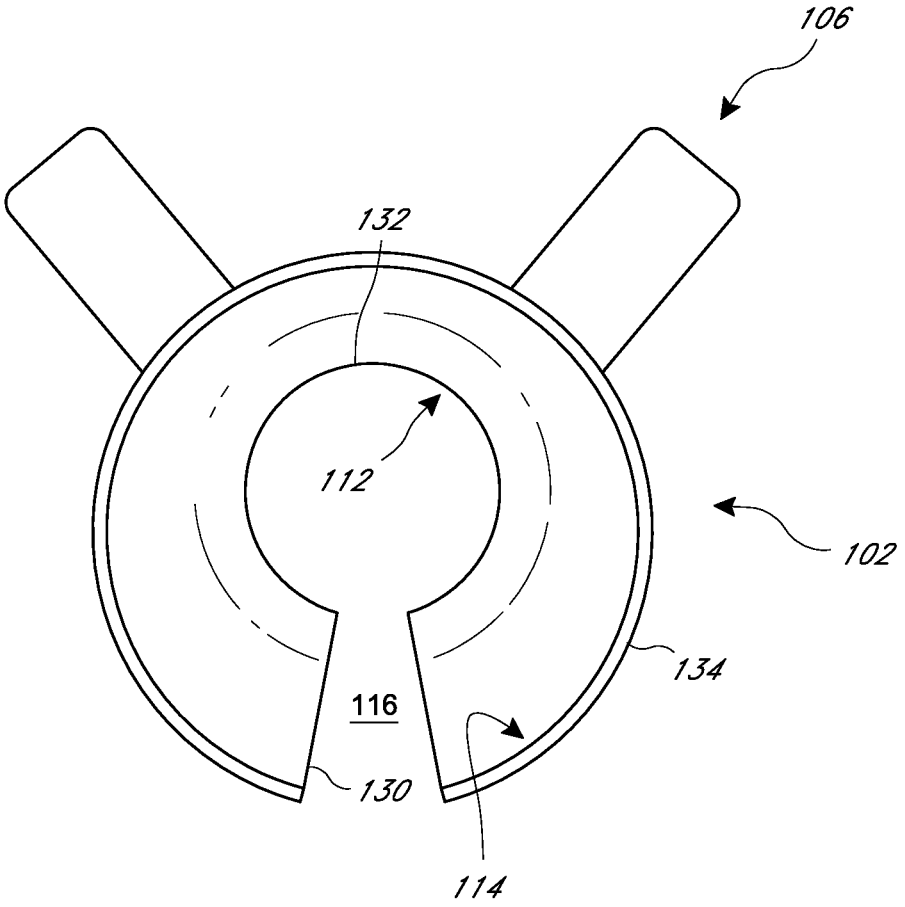
FIG. 3 illustrates a bottom perspective view of the bottle support system of FIG. 1.

With reference to FIGS. 2 and 3, the first and second handle portions 106 have handle grip portions 120 and handle attachment portions 122, 124. The first and second handle portions 106 are preferably coupled to the support body 102 at an angle less than 180 degrees apart from each other about a surface of the support body 102. In some embodiments, the first and second handle portions are coupled to the support body at an angle less than 150 degrees apart from each other about a surface of the support body. In some embodiments, the first and second handle portions are coupled to the support body at an angle less than 120 degrees apart from each other about a surface of the support body. In some embodiments, the first and second handle portions are coupled to the support body at an angle less than 90 degrees apart from each other about a surface of the support body. In some embodiments, the first and second handle portions are coupled to the support body at an angle less than 60 degrees apart from each other about a surface of the support body.

In some embodiments, the first and second handle portions 106 are coupled to the support body between about 120 degrees and about 60 degrees apart from each other about a surface of the support body. In some embodiments, the first and second handle portions are coupled to the support body between about 90 degrees and about 60 degrees apart from each other about a surface of the support body.

In some embodiments, the first and second handle portions 106 are coupled to the support body at an angle less than 180 degrees apart from the slot about a surface of the support body. In some embodiments, the first and second handle portions are coupled to the support body at an angle less than 150 degrees apart from the slot about a surface of the support body. In some embodiments, the first and second handle portions 106 are coupled to the support body at an angle less than 120 degrees apart from the slot about a surface of the support body.

In some embodiments, the first and second handle portions are coupled to the support body between about 150 degrees and about 90 degrees apart from the slot about a surface of the support body. In some embodiments, the first and second handle portions are coupled to the support body between about 150 degrees and about 120 degrees apart from the slot about a surface of the support body.

In some embodiments, the handle grip portions 120 are coupled to the support body 102 at an angle relative to a surface of the support body. In some embodiments, the handle grip portions are coupled to the support body at an angle between about 5 degrees and about 30 degrees relative to a surface of the support body. In some embodiments, the handle grip portions are coupled to the support body at an angle between about 10 degrees and about 20 degrees relative to a surface of the support body. In some embodiments, the handle grip portions are coupled to the support body at an angle of about 15 degrees relative to a surface of the support body. In some embodiments, the handle grip portions are coupled to the support body generally parallel to a surface of the support body.

In some embodiments, the first opening 112 generally defines a first opening cross-sectional area, and the second opening 114 generally defines a second opening cross-sectional area, where the second opening cross-sectional area is greater than the first opening cross-sectional area.

Figure 4:
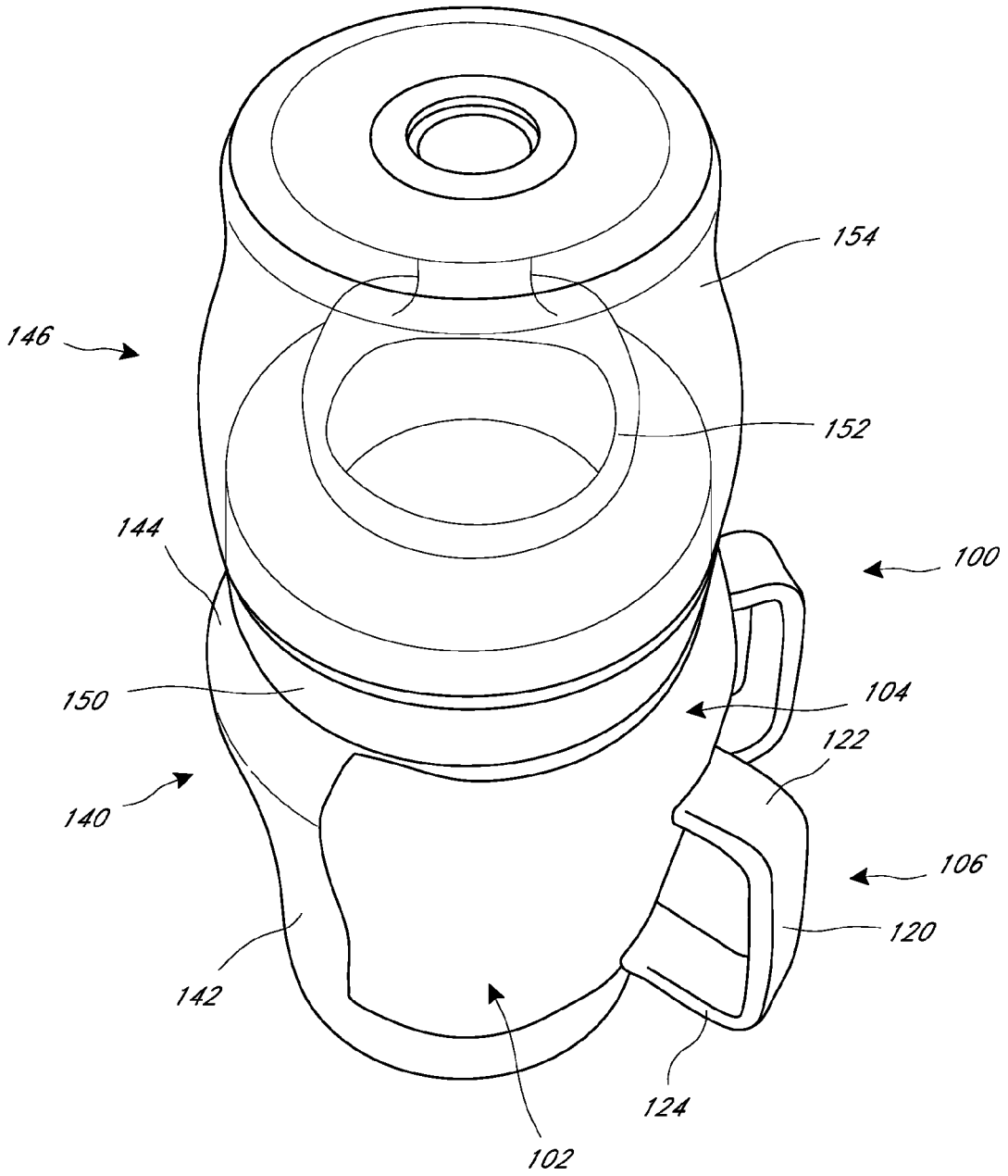
FIG. 4 illustrates a perspective view of the bottle support system of FIG. 1 coupled to a bottle system.

With reference to FIG. 4, the support body 102 is preferably sized and configured to receive, releasably grip, and support a baby bottle positioned within the channel 110 defined within the support body 102. For example, a baby bottle system 140 can include a bottle body 142, a bottle neck 144, and a cap system 146. In some embodiments, the cap system 146 can include a cap attachment 150, a nipple portion 152, and a cover 154. In some embodiments, the bottle system can comprise a baby bottle, a sippy cup, or another suitable liquid container.

The support body can comprise a flexible material, a semi-rigid material, and/or a rigid material. In some embodiments, the support body is formed of a plastic material. The handle portions of the support system can comprise a flexible material, a semi-rigid material, and/or a rigid material. In some embodiments, the handle portions are formed of a plastic material. In some embodiments, the handle portions are formed integrally with the support body. In some embodiments, the handle portions are formed monolithically with the support body. In some embodiments, the handle portions can be removably coupled to the support body. In some embodiments a single handle with multiple gripping portions can be provided. The multiple gripping portions can be configured to be positioned about the support body generally in angled locations as described herein with respect to multiple handle arrangements and/or relative to the slot position.

The slot defined in the support body and the material of the support body, are preferably configured to allow for the slot to expand and contract. For example, in some embodiments, to position a baby bottle system within the channel defined in the support body, portions of the support body can be flexed to cause expansion of the slot to a sufficient amount such that the bottle body can be inserted into the channel of the support body through the expanded slot along an axis normal to a longitudinal axis of the channel. Once the bottle system is positioned within the channel, the support body preferably contracts around the bottle system such that support body substantially forms a compression fit with the baby bottle. In a preferred configuration, a neck portion of the support body is preferably positioned about a neck portion of the bottle system. In some embodiments, the neck portion of the support body provides the advantage of supporting the bottle system at the neck portion to limit sliding or movement between the support body and the bottle system. The support body preferably holds and supports the bottle system. In some embodiments, to remove the bottle system from the support body, the bottle system is pulled toward the slot while the support body is held in position. Portions of the support body preferably flex to expand the slot and allow for the bottle system to be removed from the body support.

In some embodiments, the bottle body can be positioned within the channel along a longitudinal axis of the channel by advancing the bottle system along the longitudinal axis. In some embodiments the bottle system can be coupled to the support system using other mechanical components, including, for example, one or more of a latch, a clip, a clamp, or another suitable component to allow a support system to releasably couple to a bottle system.

In use, with the support system coupled to the bottle system, a baby or other user can hold the handles of the support system to support the bottle system. In some embodiments, the position, configuration and orientation of the handles facilitate gripping by the user. In some embodiments, the position, configuration and orientation of the handles facilitate positioning the bottle in an appropriate orientation to deliver contents of the bottle to the user. For example, in some embodiments the handles are angled relative to a surface of the support body such that when the handle gripping portions are held in a generally horizontal position by a user in a generally reclined position and/or in a generally horizontal resting position, the bottle system is preferably oriented with the nipple portion downward toward the user to facilitate delivery of the contents of the bottle to the user.

The support system can be provided on its own, or with a bottle system. In some embodiments the support system can be configured to function with a variety of bottle systems of varying shapes and sizes. The flexibility of the support system preferably allows for variations in bottle systems. The bottle support system has the advantage of providing a handle support system that is independent of a bottle or liquid container, allowing for the support system to be conveniently coupled and/or uncoupled from the bottle.

In some other embodiments, advantageous handle configurations described herein can be coupled directly to a bottle and/or bottle system itself rather than to a support system. In some other embodiments, the support system does not include a curved neck portion.

Figure 5:
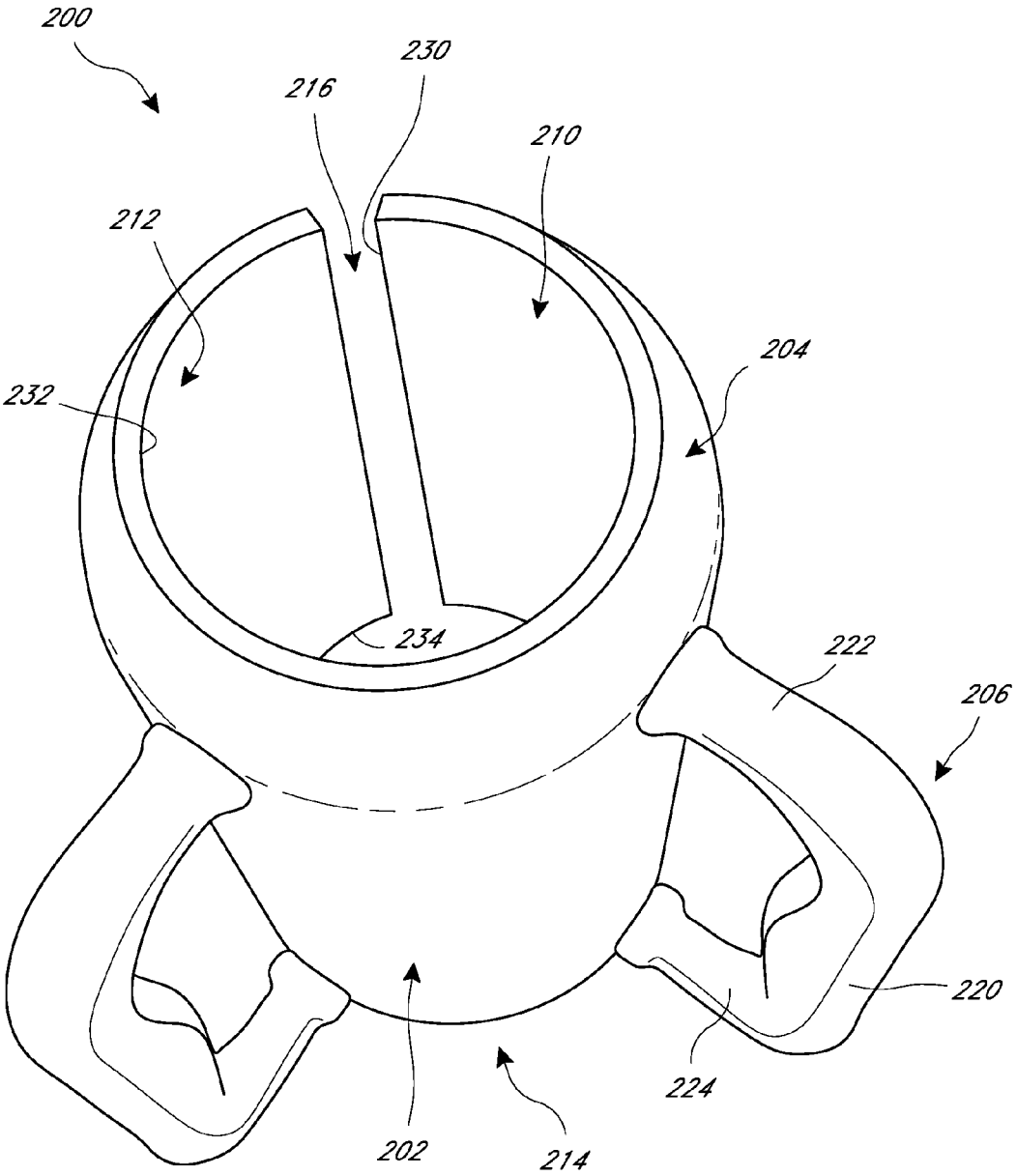
FIG. 5 illustrates a perspective view of another embodiment of a bottle support system.
Figure 6:
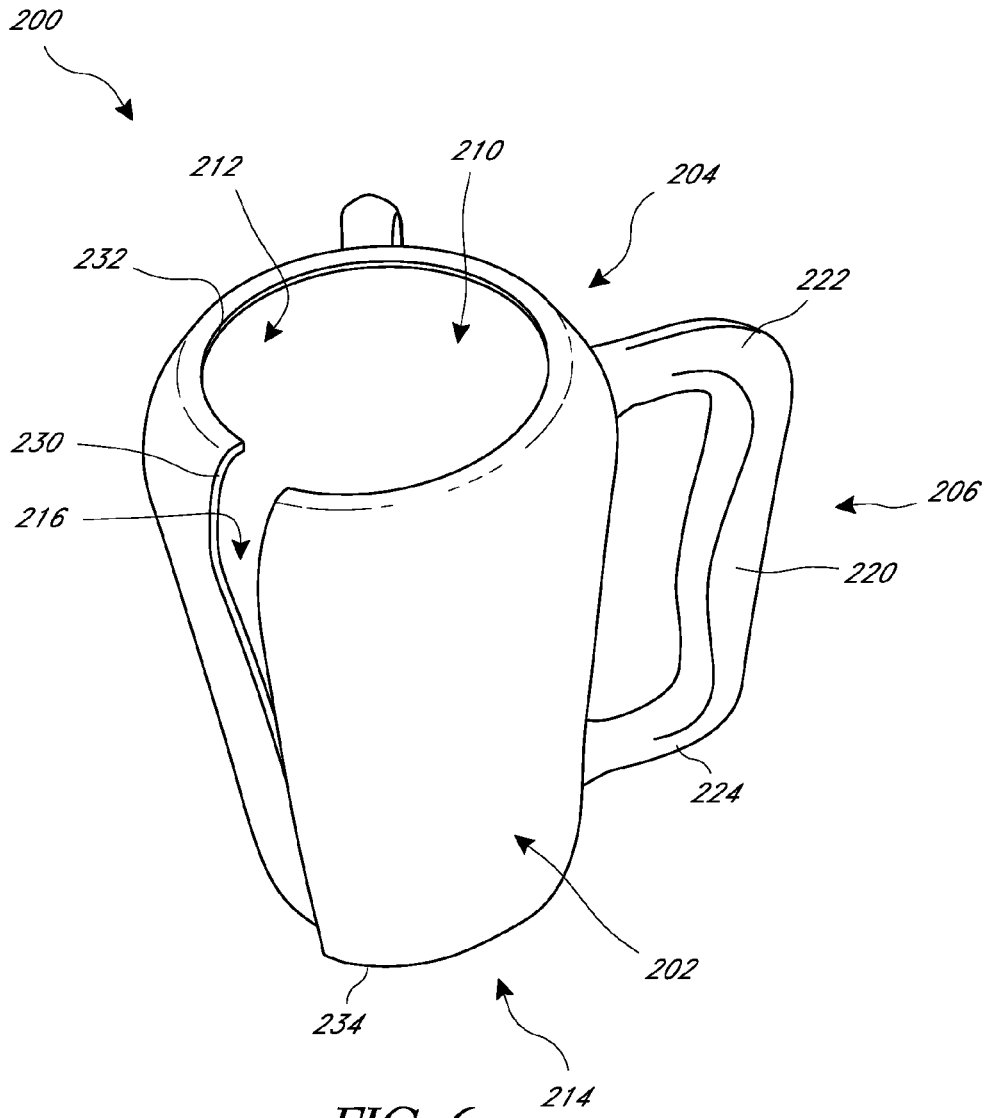
FIG. 6 illustrates a perspective view of the bottle support system of FIG. 5.

FIG. 5 illustrates a perspective view of another embodiment of a baby bottle support system 200. With reference to FIGS. 5 and 6, in some embodiments, a baby bottle support system 200 can include a support body 202 having a generally cylindrical portion. The support body 202 preferably has an upper curved section forming a neck portion 204. First and second handle portions 206 are coupled to the support body 202.

A channel 210 is defined within the support body 202 extending between a first opening 212 and a second opening 214. The first opening 212 is generally defined by a first rim 232 of the neck portion 204 at a first end portion. The second opening 214 is generally defined by a second rim 234 of the support body 202 at a second end portion. A slot 216 is generally defined between slot edges 230 of the support body 202 extending between the first end portion and the second end portion.

The first and second handle portions 206 have handle grip portions 220 and handle attachment portions 222, 224. The first and second handle portions 206 are preferably coupled to the support body 202 at an angle less than 180 degrees apart from each other about a surface of the support body 202. In some embodiments, the first and second handle portions are coupled to the support body at an angle less than 150 degrees apart from each other about a surface of the support body. In some embodiments, the first and second handle portions are coupled to the support body at an angle less than 120 degrees apart from each other about a surface of the support body. In some embodiments, the first and second handle portions are coupled to the support body at an angle less than 90 degrees apart from each other about a surface of the support body. In some embodiments, the first and second handle portions are coupled to the support body at an angle less than 60 degrees apart from each other about a surface of the support body.

In some embodiments, the first and second handle portions 206 are coupled to the support body between about 120 degrees and about 60 degrees apart from each other about a surface of the support body. In some embodiments, the first and second handle portions are coupled to the support body between about 90 degrees and about 60 degrees apart from each other about a surface of the support body.

In some embodiments, the first and second handle portions 206 are coupled to the support body at an angle less than 180 degrees apart from the slot about a surface of the support body. In some embodiments, the first and second handle portions are coupled to the support body at an angle less than 150 degrees apart from the slot about a surface of the support body.

In some embodiments, the first and second handle portions 206 are coupled to the support body at an angle less than 120 degrees apart from the slot about a surface of the support body. In some embodiments, the first and second handle portions are coupled to the support body between about 150 degrees and about 90 degrees apart from the slot about a surface of the support body. In some embodiments, the first and second handle portions are coupled to the support body between about 150 degrees and about 120 degrees apart from the slot about a surface of the support body.

In some embodiments, the handle grip portions 220 are coupled to the support body generally parallel to a surface of the support body 202. In some embodiments, the handle grip portions are coupled to the support body at an angle relative to a surface of the support body. In some embodiments, the handle grip portions are coupled to the support body at an angle between about 5 degrees and about 30 degrees relative to a surface of the support body. In some embodiments, the handle grip portions are coupled to the support body at an angle between about 10 degrees and about 20 degrees relative to a surface of the support body. In some embodiments, the handle grip portions are coupled to the support body at an angle of about 15 degrees relative to a surface of the support body.

In some embodiments, the first opening 212 generally defines a first opening cross-sectional area, and the second opening 214 generally defines a second opening cross-sectional area, where the second opening cross-sectional area is greater than the first opening cross-sectional area.

Figure 7:
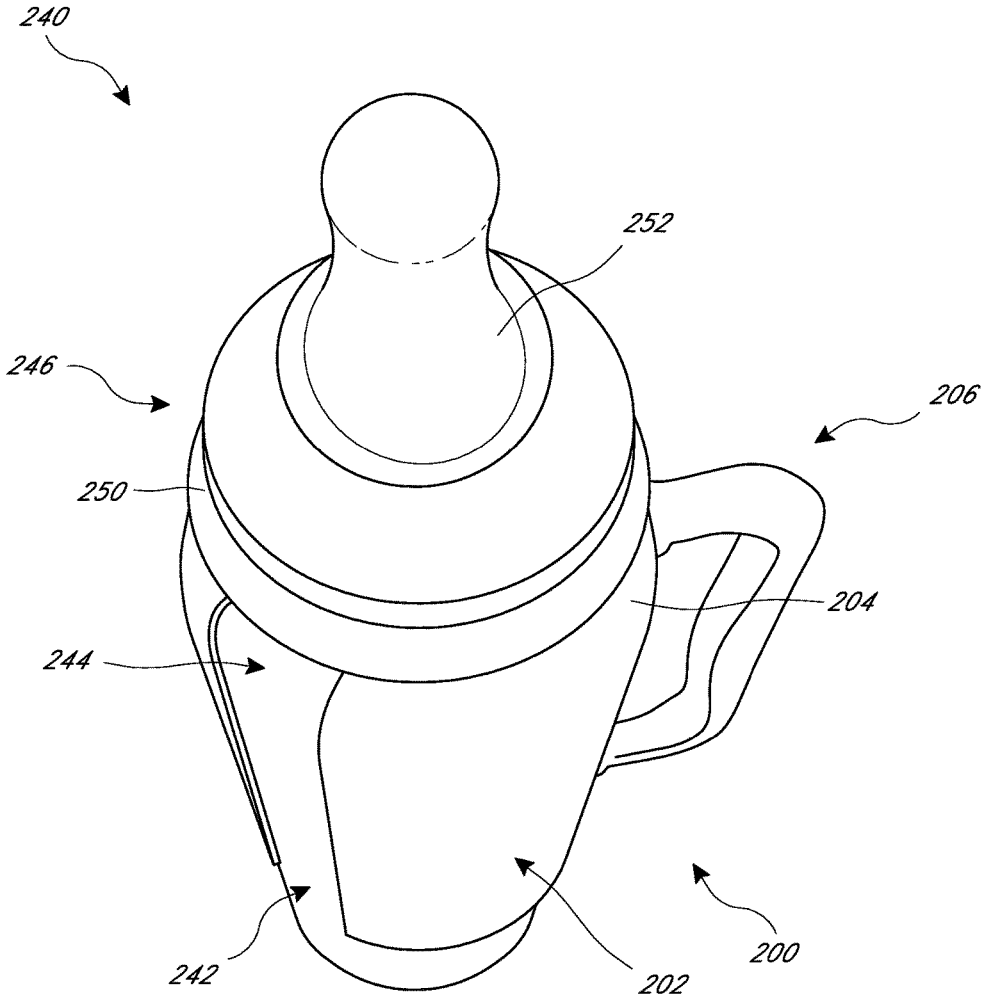
FIG. 7 illustrates a perspective view of the bottle support system of FIG. 5 coupled to a bottle system.
Figure 8:
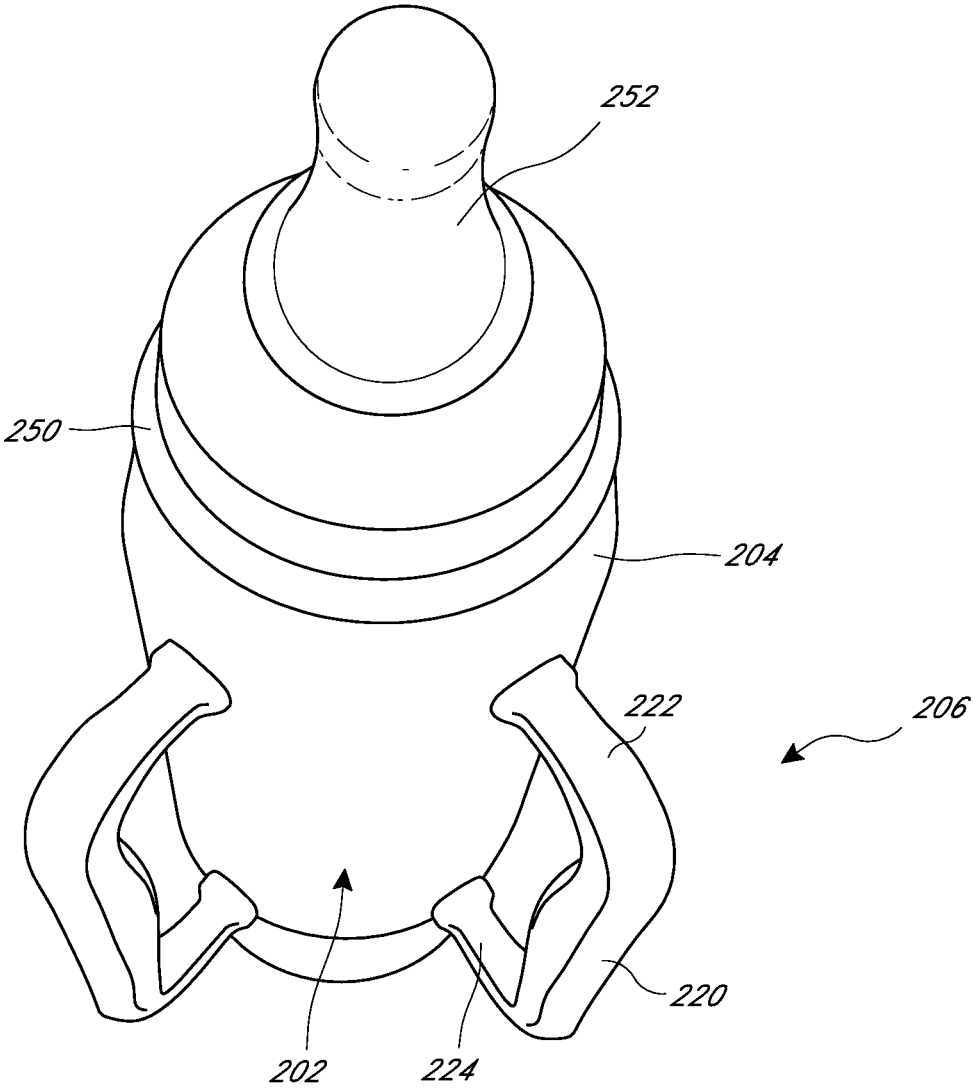
FIG. 8 illustrates a perspective view of the bottle support system of FIG. 5 coupled to a bottle system.

With reference to FIGS. 7 and 8, the support body 202 is preferably sized and configured to receive, releasably grip, and support a baby bottle positioned within the channel 210 defined within the support body 202. For example, a baby bottle system 240 can include a bottle body 242, a bottle neck 244, and a cap system 246. In some embodiments, the cap system 246 can include a cap attachment 250, and a nipple portion 252. The system can be used and/or modified as described in connection with other embodiments and variations disclosed herein.

Various modifications to the implementations described in this disclosure may be readily apparent to those skilled in the art, and the principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations. Additionally, other implementations are within the scope of the following claims. In some cases, the actions recited in the claims can be performed in a different order and still achieve desirable results.

In describing the present technology, the following terminology may have been used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The terms "generally" and "substantially" mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. A support system for a baby bottle comprising:

a support body having a generally cylindrical portion, a neck portion, a first end portion and a second end portion, wherein the first end portion generally defines a first opening having a first opening cross-sectional area, and the second end portion generally defines a second opening having a second cross-sectional area, wherein the second opening cross-sectional area is greater than the first opening cross-sectional area, a channel defined within the support body extending between the first opening and the second opening, and a slot defined between slot edges of the support body extending between the first end portion and the second end portion; and first and second handle portions coupled to the support body, the first and second handle portions having handle grip portions and handle attachment portions;

wherein the support body is sized and configured to support a baby bottle positioned within the channel defined within the support body.

2. The system of claim 1, wherein the first and second handle portions are coupled to the support body at an angle less than 150 degrees apart from each other about a surface of the support body.

3. The system of claim 1, wherein the first and second handle portions are coupled to the support body at an angle less than 120 degrees apart from each other about a surface of the support body.

4. The system of claim 1, wherein the first and second handle portions are coupled to the support body at an angle less than 90 degrees apart from each other about a surface of the support body.

5. The system of claim 1, wherein the first and second handle portions are coupled to the support body at an angle less than 60 degrees apart from each other about a surface of the support body.

6. The system of claim 1, wherein the first and second handle portions are coupled to the support body between about 120 degrees and about 60 degrees apart from each other about a surface of the support body.

7. The system of claim 1, wherein the first and second handle portions are coupled to the support body between about 90 degrees and about 60 degrees apart from each other about a surface of the support body.

8. The system of claim 1, wherein the first and second handle portions are coupled to the support body at an angle less than 180 degrees apart from the slot about a surface of the support body.

9. The system of claim 1, wherein the first and second handle portions are coupled to the support body at an angle less than 150 degrees apart from the slot about a surface of the support body.

10. The system of claim 1, wherein the first and second handle portions are coupled to the support body at an angle less than 120 degrees apart from the slot about a surface of the support body.

11. The system of claim 1, wherein the first and second handle portions are coupled to the support body between about 150 degrees and about 90 degrees apart from the slot about a surface of the support body.

12. The system of claim 1, wherein the first and second handle portions are coupled to the support body between about 150 degrees and about 120 degrees apart from the slot about a surface of the support body.

13. The system of claim 1, wherein the handle grip portions are coupled to the support body generally parallel to a surface of the support body.

14. The system of claim 1, wherein the handle grip portions are coupled to the support body at an angle relative to a surface of the support body.

15. The system of claim 1, wherein the handle grip portions are coupled to the support body at an angle between about 5 degrees and about 30 degrees relative to a surface of the support body.

16. The system of claim 1, wherein the handle grip portions are coupled to the support body at an angle between about 10 degrees and about 20 degrees relative to a surface of the support body.

17. The system of claim 1, wherein the handle grip portions are coupled to the support body at an angle of about 15 degrees relative to a surface of the support body.

18. A support system for a baby bottle comprising:

a support body having a generally cylindrical portion, a first end portion and a second end portion, wherein the first end portion generally defines a first opening having a first opening cross-sectional area, and the second end portion generally defines a second opening having a second cross-sectional area, wherein the second opening cross-sectional area is greater than the first opening cross-sectional area, a channel defined within the support body, and a slot defined in the support body extending between the first end portion and the second end portion; and first and second handle portions coupled to the support body, wherein the first and second handle portions are coupled to the support body at an angle less than about 180 degrees apart from each other about a surface of the support body;

wherein the support body is sized and configured to support a baby bottle positioned within the channel defined within the support body.

19. The system of claim 18, wherein the first and second handle portions have handle grip portions that are coupled to the support body at an angle between about 5 degrees and about 30 degrees relative to a surface of the support body.

20. A baby bottle holding system, comprising:

a baby bottle;

a support body having a first end portion and a second end portion, wherein the first end portion generally defines a first opening having a first opening cross-sectional area, and the second end portion generally defines a second opening having a second cross-sectional area, wherein the second opening cross-sectional area is greater than the first opening cross-sectional area, a channel defined within the support body, and a slot defined in the support body extending between the first end portion and the second end portion; and first and second handle portions coupled to the support body;

wherein the support body is sized and configured to support the baby bottle when positioned within the channel defined within the support body.

21. The system of claim 20, wherein the first and second handle portions have handle grip portions that are coupled to the support body at an angle between about 5 degrees and about 30 degrees relative to a surface of the support body.

22. The system of claim 18, wherein the first and second handle portions are coupled to the support body at an angle less than about 120 degrees apart from each other about a surface of the support body.

23. The system of claim 18, wherein a curved neck portion of the support body forms a partial dome configuration and generally defines the first opening.

24. The system of claim 20, wherein the first and second handle portions are coupled to the support body at an angle less than about 120 degrees apart from each other about a surface of the support body.

25. The system of claim 20, wherein a curved neck portion of the support body forms a partial dome configuration and generally defines the first opening.

* * * * *